United States Patent [19]

Grove

[11] 4,127,379

[45] Nov. 28, 1978

[54] FEEDING WATER-LADEN AIR INTO A CONTINUOUS OPEN FLAME

[76] Inventor: Leslie H. Grove, 707 E. Hoyt Ave., St. Paul, Minn. 55106

[21] Appl. No.: 759,102

[22] Filed: Jan. 13, 1977

[51] Int. Cl.[2] ..... F23J 7/00

[52] U.S. Cl. ..... 431/4; 123/25 R; 431/190

[58] Field of Search ..... 431/3, 4, 190; 261/18 A; 123/25 R

[56] References Cited

U.S. PATENT DOCUMENTS

| | | | |
|---|---|---|---|
| 3,291,182 | 12/1966 | Dow et al. | 431/190 X |
| 3,862,819 | 1/1975 | Wentworth | 431/4 |
| 4,009,984 | 3/1977 | Morrison | 431/4 |
| 4,014,637 | 3/1977 | Schena | 431/4 |

*Primary Examiner*—Edward G. Favors
*Attorney, Agent, or Firm*—Robert E. Granrud

[57] ABSTRACT

Water-laden air is fed directly into an open flame at a controlled rate, thus substantially improving the efficiency of combustion.

10 Claims, 3 Drawing Figures

FEEDING WATER-LADEN AIR INTO A CONTINUOUS OPEN FLAME

CROSS-REFERENCE TO RELATED APPLICATION

The invention of this application is closely related to application Ser. No. 759,190, filed Mar. 11, 1977 by the same applicant, entitled "Feeding Steam Into a Continuous Open Flame". In the present invention the water-laden air is fed into the flame at a temperature below the boiling point of water. Hence, the water which is fed into the flame is not steam, although the heat of the flame immediately converts it into steam.

FIELD OF THE INVENTION

This invention relates to burners such as furnaces and ovens having open continuous flames and concerns improvements in the heat output or efficiency of the combustion.

BACKGROUND OF THE INVENTION

Prior efforts to improve fuel combustion have primarily been aimed at improving the fuel or the manner of mixing the fuel with air or of ejecting the fuel mixture to feed a flame. Current techniques approach theoretical perfection. A whole new approach would be required to accomplish any major breakthrough in the efficiency of the combustion.

PERTINENT PRIOR ART

It is generally recognized that internal combustion engines tend to operate more efficiently when operated under conditions of high humidity. The Holly carburetor, which was used on the Fordson tractor about 60–70 years ago, included a tank of water over which the combustion air was drawn after the engine head reached operating temperature. The mechanism which routed the air intake simultaneously switched the fuel from gasoline (used for warmup) to kerosene. It was recognized that the water vapor in the combustion air enhanced the efficiency of combustion.

In some oil boilers, steam is injected at the nozzle into the oil in order to heat the oil to lower its viscosity and to vaporize it more readily. This enhances the efficiency of combustion.

Many furnaces employ the heat of exhaust gases to preheat the fuel-air mixture and thus attain significant fuel savings.

The power of certain World War II aircraft engines was markedly increased by injecting water directly into the intake manifold. The water was injected only for brief periods of time to forestall burning of the valves.

THE PRESENT INVENTION

A major breakthrough in the efficiency of combustion of a continuous open flame is here achieved by feeding directly into the flame water-laden air at a temperature below the boiling point of water. By "continuous" is meant a flame which usually burns continuously for at least one minute at a time. A significant increase in efficiency of combustion is attained if the water-laden air is fed into the flame at a controlled rate such that the oxygen in the form of water exceeds 5% of the oxygen (as air) required for complete combustion of the fuel.

When the hot water-laden air is first fed into a continuous open flame, any yellow or red color tends to disappear, and the entire flame becomes blue and lengthens in a pulsating manner. The maximum length of the pulsating flame may substantially exceed that of the unmodified flame. If the flame tends to grow to a length exceeding that of the combustion chamber, the flame should be directed into a devious (e.g., helical) path.

When the flame is shut off, the flow of the water-laden air should be interrupted until after the flame is re-ignited. Usually a delay of 5–10 seconds after re-ignition should be sufficient to insure against accidentally extinguishing the flame.

Even better efficiency of combustion is obtained if a fuel is dissolved in the water vapor of the water-laden air. This may be accomplished by dissolving a volatile fuel such as alcohol in a tank of water across which air is blown to pick up the water vapor. Where the source of the water-laden air is provided by drying a substance, the volatile matter may inherently include fuel dissolved in the water vapor of the water-laden air. Such substances include cotton, grain, milk, fish, eggs, wood, textiles, feces and latex paint.

Whether or not the water-laden air includes a fuel, best results are achieved when the temperature of the water-laden air exceeds 60° C. and its relative humidity is at least 70%. For convenience in controlling the total water to which the flame is exposed, the relative humidity may normally be maintained within a range of 70–90%, but increased above 90% when the moisture content of the combustion air is abnormally low. Under conditions of high ambient humidity, the combustion air may furnish a significant amount of water to the flame. However, in any installation designed to feed water-laden air into a flame at a rate such that the oxygen as water exceeds 50% of the oxygen required for complete combustion, the normal air intake should be redesigned to restrict the amount of ambient air drawn into the flame after the water-laden air is fed into the flame. This virtually eliminates any danger of accidentally extinguishing the flame.

By feeding water-laden air into the flame, the amount of excess combustion air normally required can be substantially reduced. For installations in which it would be inconvenient to reduce the flow of combustion air mechanically, part of the water-laden air may be fed into the combustion air line to replace part of the combustion air.

When the ambient humidity is very high, the normal combustion air for natural gas may contain water in an amount furnishing oxygen (as water) about equaling 5% of the oxygen (as air) theoretically required for complete combustion. In installations where the ambient humidity is consistently high, there is less advantage in replacing part of the normal combustion air with part of the water-laden air.

The invention is applicable to a variety of fuels including methane, petroleum oil, wood, coal and kerosene. It is especially suitable for installations where it would be inconvenient to generate steam to use instead of the water-laden air, e.g., for an ordinary home heating plant.

Where air is drawn across a tank of water to provide the water-laden air, the air may be heated before being drawn across the tank of water and its temperature may substantially exceed 100° C. as it begins to cross the water. Also, the tank of water may be heated. However, before the water-laden air reaches the flame of the furnace, the cooling effect of evaporation reduces its temperature below the boiling point. The heat of the flame instantaneously converts the water into steam upon entering the combustion chamber.

THE DRAWING

Figure 1:
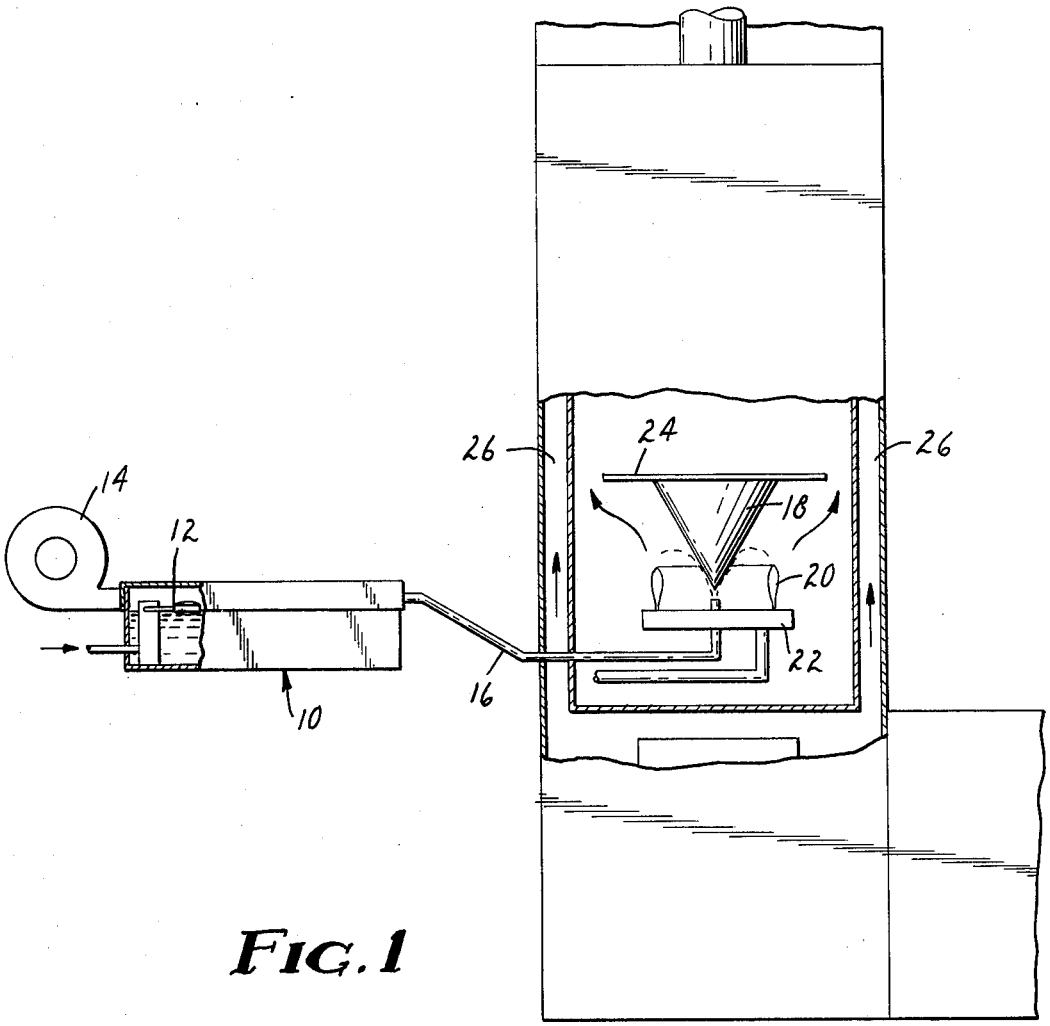
FIG. 1 is a schematic elevation, partly cut away to central section to illustrate the application of the invention to an ordinary forced-air home furnace.

As seen in FIG. 1, a shallow tank of water 10 is maintained at constant level by a conventional float valve 12. A blower 14 carries a stream of air across the water 10 and through a duct 16. An inverted steel cone 18 deflects the water-laden air emitted from the duct 16 directly into the flame 20 rising from a circular burner 22. A flange 24 at the base of the inverted steel cone 17 directs the flame 20 outwardly to the wall of the combustion chamber, both lengthening the path of the flame and more effectively heating the hot-air ducts 26.

Figure 2:
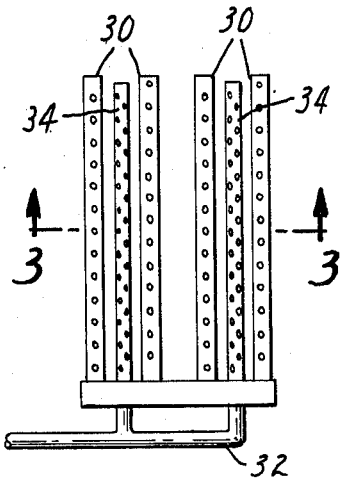
FIG. 2 illustrates the application of the invention to a burner of different configuration than that employed in the furnace of FIG. 1.
Figure 3:
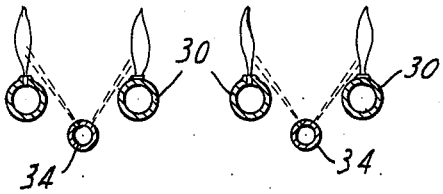
FIG. 3 is an enlarged cross-section along line 3—3 of FIG. 2.

The burner shown in FIGS. 2 and 3 consists of four horizontal pipes 30. Water-laden air carried by ductwork 32 is emitted from vents in tubing 34 directly into the flame at corresponding vents of the pipes 30.

I claim:

1. Method of improving the efficiency of a continuous open flame comprising feeding water-laden air of at least 70% relative humidity directly into the flame at a controlled rate such that the oxygen of the water exceeds 5% of the oxygen theoretically required for complete combustion.

2. Method as defined in claim 1 wherein the water vapor of the water-laden air contains dissolved fuel.

3. Method as defined in claim 1 wherein the temperature of the water-laden air exceeds 60° C. and is less than the boiling point of water.

4. Method as defined in claim 3 wherein the relative humidity of the water-laden air is 70–90%.

5. Method as defined in claim 3 wherein the amount of oxygen of the water exceeds 50% of the oxygen theoretically required for complete combustion and the amount of ambient air drawn into the flame is reduced below normal to eliminate danger of accidentally extinguishing the flame.

6. A burner having a continuous open flame and means for feeding water-laden air of at least 70% relative humidity directly into the flame at a controlled rate such that the oxygen of the water exceeds 5% of the oxygen theoretically required for complete combustion.

7. A burner as defined in claim 6 including means for dissolving fuel into the water vapor of the water-laden air.

8. A burner as defined in claim 6 wherein said means for feeding water-laden air feeds the water-laden air at a controlled rate such that the oxygen of the water exceeds 50% of the oxygen theoretically required for complete combustion.

9. A burner as defined in claim 8 further including means for restricting the amount of ambient air drawn into the flame to insure against accidentally extinguishing the flame.

10. A burner as defined in claim 9 including means for heating the water-laden air to a temperature of 60° C. but less than the boiling point of water.

* * * * *